US006331766B1

(12) United States Patent
Kalpakjian et al.

(10) Patent No.: US 6,331,766 B1
(45) **Date of Patent: *Dec. 18, 2001**

(54) FREQUENCY SENSING NMOS VOLTAGE REGULATOR

(75) Inventors: Kent M. Kalpakjian, Boise; John D. Porter, Meridian, both of ID (US)

(73) Assignee: Micron Technology, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/692,472

(22) Filed: Oct. 20, 2000

Related U.S. Application Data

(63) Continuation of application No. 09/386,312, filed on Aug. 31, 1999, now Pat. No. 6,175,221.

(51) Int. Cl.[7] ..... G05F 1/44; G05F 1/40; G05F 1/56

(52) U.S. Cl. ..... 323/268; 323/274

(58) Field of Search ..... 323/268, 270, 323/273, 274, 275

(56) References Cited

U.S. PATENT DOCUMENTS

| | | | | |
|---|---|---|---|---|
| 3,914,702 | | 10/1975 | Gehweiler | 330/264 |
| 4,267,501 | | 5/1981 | Smith | 323/313 |
| 4,638,184 | | 1/1987 | Kimura | 327/541 |
| 4,644,184 | * | 2/1987 | Miyawaki et al. | 327/269 |
| 4,700,124 | | 10/1987 | Anderson | 323/225 |
| 4,956,720 | | 9/1990 | Tomisawa | 386/21 |
| 5,012,141 | | 4/1991 | Tomisawa | 327/276 |
| 5,130,635 | | 7/1992 | Kase | 323/280 |
| 5,568,084 | * | 10/1996 | McClure et al. | 327/538 |
| 5,654,663 | * | 8/1997 | McClure et al. | 327/530 |
| 5,847,554 | | 12/1998 | Wilcox et al. | 323/282 |
| 5,867,048 | | 2/1999 | Chou | 327/127 |
| 5,874,830 | | 2/1999 | Baker | 323/316 |
| 6,005,819 | | 12/1999 | Shin | 365/226 |

* cited by examiner

*Primary Examiner*—Peter S. Wong
*Assistant Examiner*—Bao Q. Vu
(74) *Attorney, Agent, or Firm*—Dickstein Shapiro Morin & Oshinsky LLP

(57) ABSTRACT

A frequency sensing NMOS voltage regulator is disclosed. A NMOS source follower transistor has a gate connected to a predetermined gate voltage, a drain coupled to an external supply voltage through a PMOS switching transistor, and a source connected to a load. The gate of the PMOS transistor is controlled by a delay circuit through which a pulse derived from the system clock is passed. Through the use of the delay circuit and the PMOS transistor, the amount of current produced by the NMOS transistor is made a function of the cycle rate of the system clock and the current provided by the NMOS transistor tracks the frequency-dependent current requirements of the load, resulting in a reduced variance of the supply voltage Vcc over a wide current range.

19 Claims, 6 Drawing Sheets

FREQUENCY SENSING NMOS VOLTAGE REGULATOR

This application is a continuation application of U.S. patent application Ser. No. 09/386,312 filed Aug. 31, 1999, U.S. Pat. No. 6,175,221, the entirety of which is incorporated herein by references.

BACKGROUND OF THE INVENTION

1. Field of the Invention

The present invention relates generally to voltage regulators, and more particularly to a frequency sensing voltage regulator that uses the system operating frequency to limit the amount of current delivered to a load, thereby regulating the variance of the supply voltage to the load.

2. Description of the Related Art

Voltage regulator circuits are known in which a voltage supply to a load is regulated by controlling the current supplied to the load. Typical of such prior art structures is the use of a negative feedback circuit for sensing the output voltage and/or output current which is used for comparison with a reference voltage/reference current. The difference between the output and the reference signal is used to adjust the current supplied to a load.

There are problems, however, with such voltage regulators. A considerable amount of power is drawn, and thus heat dissipated, because of the use of the negative feedback circuit. In addition, the negative feedback circuit decreases the response time to sharp current fluctuations. Furthermore, the comparator circuits and reference level generating circuits take up considerable layout area when the voltage regulator is incorporated in an integrated circuit (IC) structure.

Additional problems also occur when a voltage regulator is used to regulate the supply voltage to a synchronous device, such as a synchronous memory device, for example an SRAM. In an SRAM, an external supply voltage, Vcc, must be maintained within a predetermined level. The external supply voltage Vcc must be regulated to produce a regulated Vcc value during periods of considerable current fluctuation. For example, an SRAM load current may quickly fluctuate between microamps and milliamps during use. Such changes in the load current can cause significant variation on the regulated Vcc value, which can result in improper operation of the SRAM or possibly even damage to the SRAM.

Thus, there exists a need for a voltage regulator that is easy to implement, does not occupy significant layout area when the voltage regulator is incorporated in an integrated circuit (IC), and provides a minimal variance of the supply voltage Vcc over a wide current range.

SUMMARY OF THE INVENTION

The present invention is designed to mitigate problems associated with the prior art by providing a frequency sensing NMOS voltage regulator that is easy to implement, does not occupy significant layout area when the voltage regulator is incorporated in an integrated circuit (IC), and provides a minimal variance of the supply voltage Vcc over a wide current range. The present invention takes advantage of the fact that current tracks frequency in a linear fashion for synchronous systems.

In accordance with the present invention, a NMOS source follower transistor has a gate connected to a fixed gate voltage, a drain coupled to an external supply voltage through a PMOS switching transistor, and a source connected to a load. The gate of the PMOS transistor is controlled by a delay circuit through which the clock pulse of the system is passed. Through the use of the delay circuit and the PMOS transistor, the amount of current provided by the NMOS transistor is made a function of the cycle rate of the clock pulse, tracking the current requirements of the load. This results in a reduced variance of the regulated supply voltage Vcc over a wide current range.

These and other advantages and features of the invention will become apparent from the following detailed description of the invention which is provided in connection with the accompanying drawings.

DETAILED DESCRIPTION OF THE PREFERRED EMBODIMENTS

Figure 1:
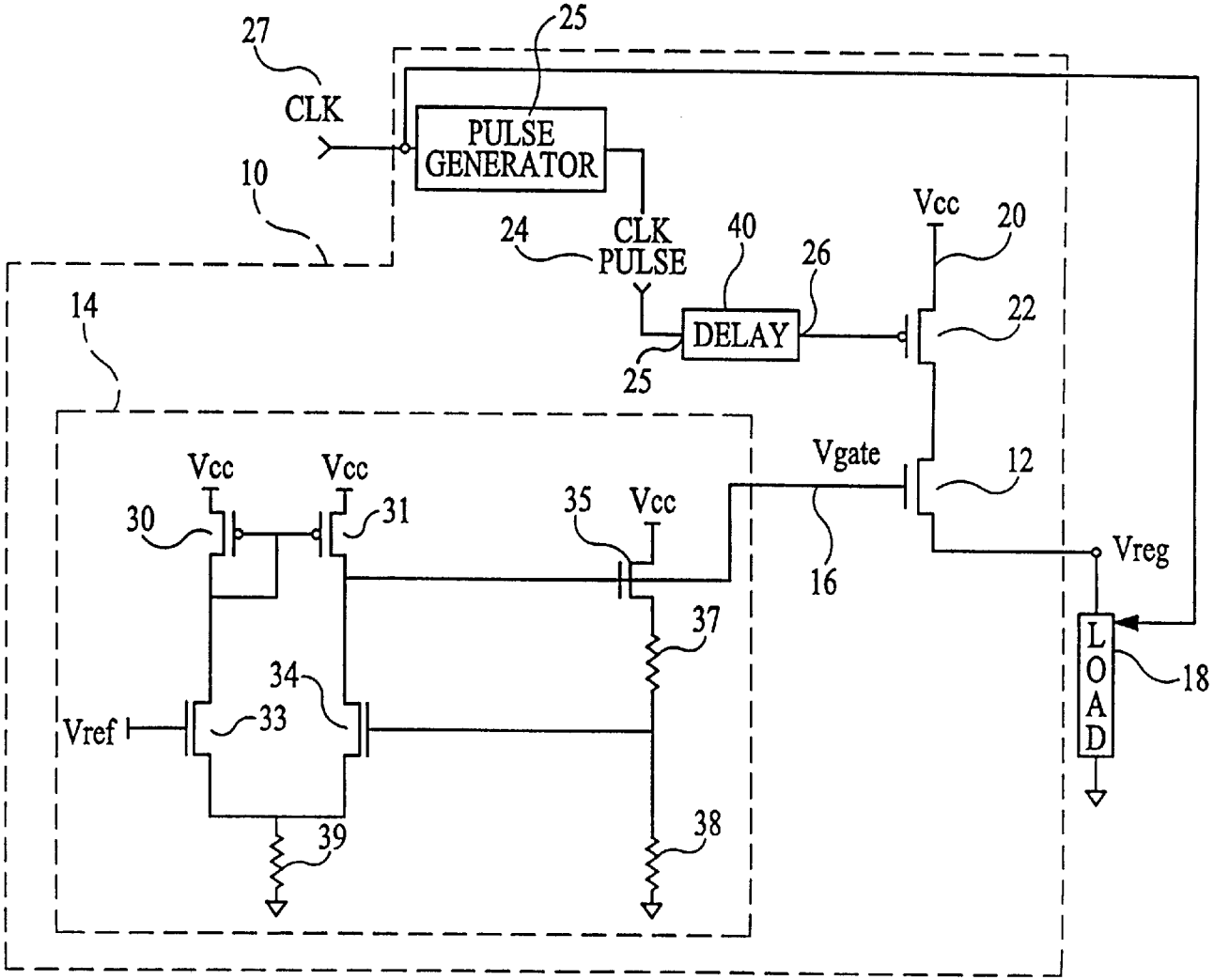
FIG. 1 illustrates a NMOS voltage regulator in accordance with the present invention.

The present invention will be described as set forth in the preferred embodiment illustrated in FIGS. 1–6. Other embodiments may be utilized and structural or logical changes may be made and equivalents substituted without departing from the spirit or scope of the present invention. Like items are referred to by like reference numerals throughout the drawings.

The present invention provides a frequency sensing NMOS voltage regulator that is easy to implement, does not occupy significant layout area when the voltage regulator is incorporated in an integrated circuit (IC), and provides a minimal variance of the supply voltage Vcc over a wide current range. FIG. 1 illustrates a voltage regulator 10 in accordance with the present invention. Voltage regulator 10 includes a NMOS source follower transistor 12 connected to a control circuit 14 via line 16. The drain of transistor 12 is coupled to an external supply voltage Vcc 20 through a PMOS transistor 22. The source of transistor 12 provides a regulated voltage Vreg to a load 18. In accordance with the present invention, the output 26 of a delay circuit 40 is connected to the gate of PMOS transistor 22. The input 25 of delay circuit 40 is connected to the clock pulse signal CLK PULSE 24 which is the output of a pulse generator 25 driven by the CLK 27 of the system in which the voltage regulator is installed.

Control circuit 14, which provides a predetermined gate voltage Vgate to transistor 12, includes a pair of PMOS transistors 30, 31, NMOS transistors 33, 34, 35, and resistors 37, 38, and 39. External supply voltage Vcc 20 and a reference voltage Vref 29 are used to supply the fixed gate voltage Vgate 16 to the gate of transistor 12 during operation of the voltage regulator 10. It should be understood that although one method of supplying a predetermined gate voltage to transistor 12, i.e., control circuit 14, has been illustrated, any method as is known in the art may be used with the present invention.

Figure 2:
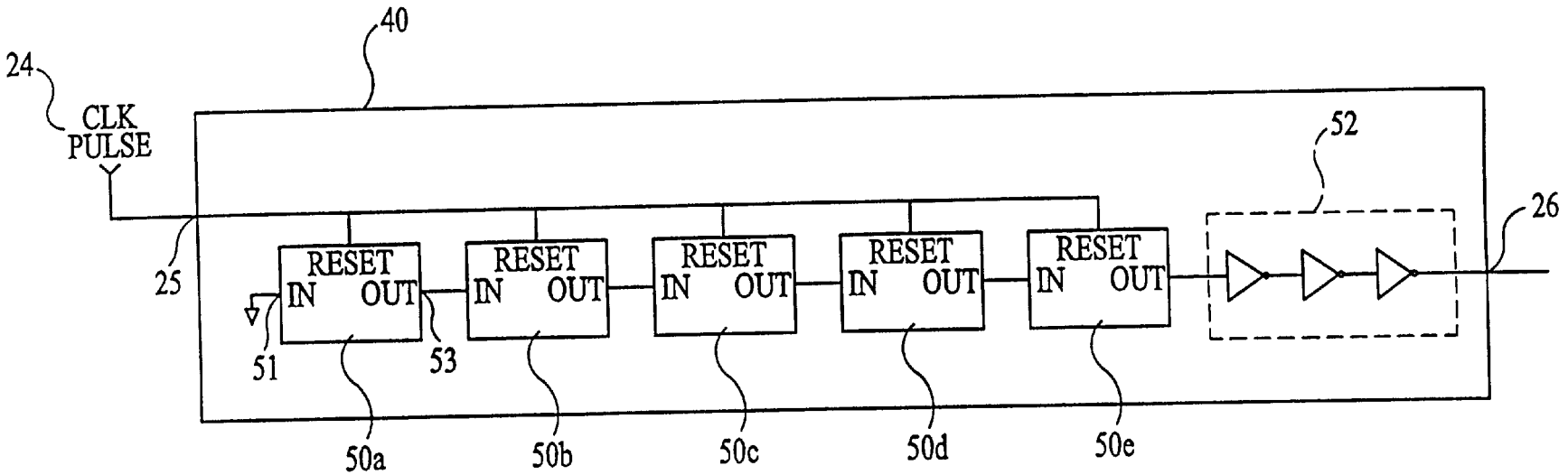
FIG. 2 illustrates the delay circuit of FIG. 1.

FIG. 2 illustrates the delay circuit 40 of FIG. 1. Delay circuit 40 includes a plurality of delay chains 50*a*–50*e* each having a signal input, a signal output and a reset input, connected in series. The input 51 of the first delay chain 50*a* is connected to ground in this embodiment. The output 53 of delay chain 50*a* is connected to the input of delay chain 50*b*, the output of the delay chain 50*b* is connected to the input of delay chain 50*c* and so forth up to delay chain 50*e*. While five delay chains 50*a*–50*e* are illustrated, the invention is not so limited and any number of delay chains 50*a*–50*e* may be used depending upon the desired delay, nor are the types of delay elements used within 50*a*–50*e* required to be identical.

The clock pulse signal CLK PULSE 24 is connected to the reset input of each delay chain 50*a*–50*e*. The output of the last delay chain 50*e* is connected to a plurality of inverters 52, of which three are shown in this embodiment, connected in series.

Figure 3:
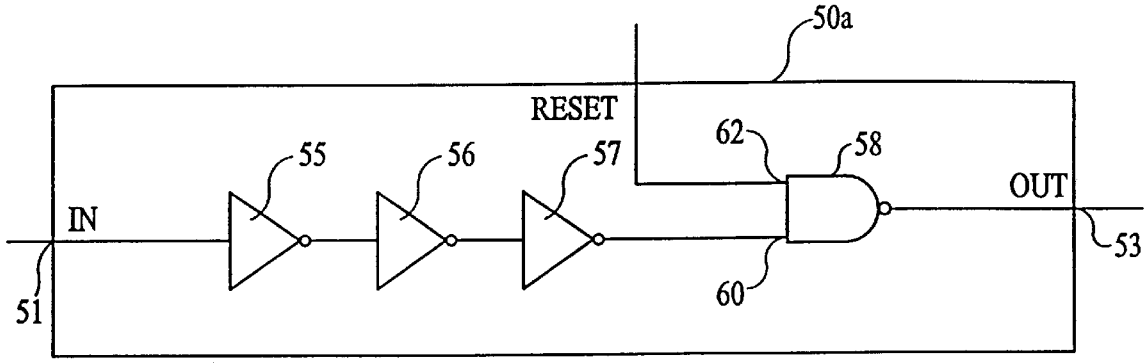
FIG. 3 illustrates a delay chain that may be used in the delay circuit of FIG. 2.

FIG. 3 illustrates a delay chain 50*a* that can be used in the delay circuit 40 of FIG. 2. Delay chain 50*a* includes three inverters 55, 56, 57 connected in series and a NAND gate 58 having a first input 60 connected to the output of the last inverter 57 and a second input 62 connected to the clock pulse signal CLK PULSE 24 via the reset input.

Figure 4A:
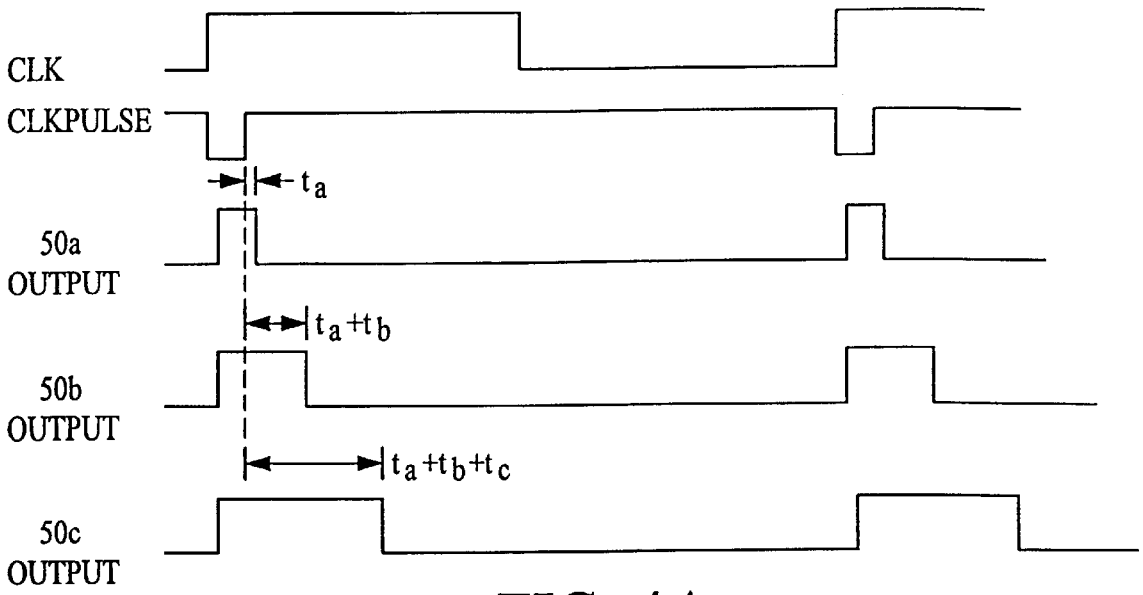
FIGS. 4A and 4B illustrate timing diagrams of various clock signals.
Figure 4B:
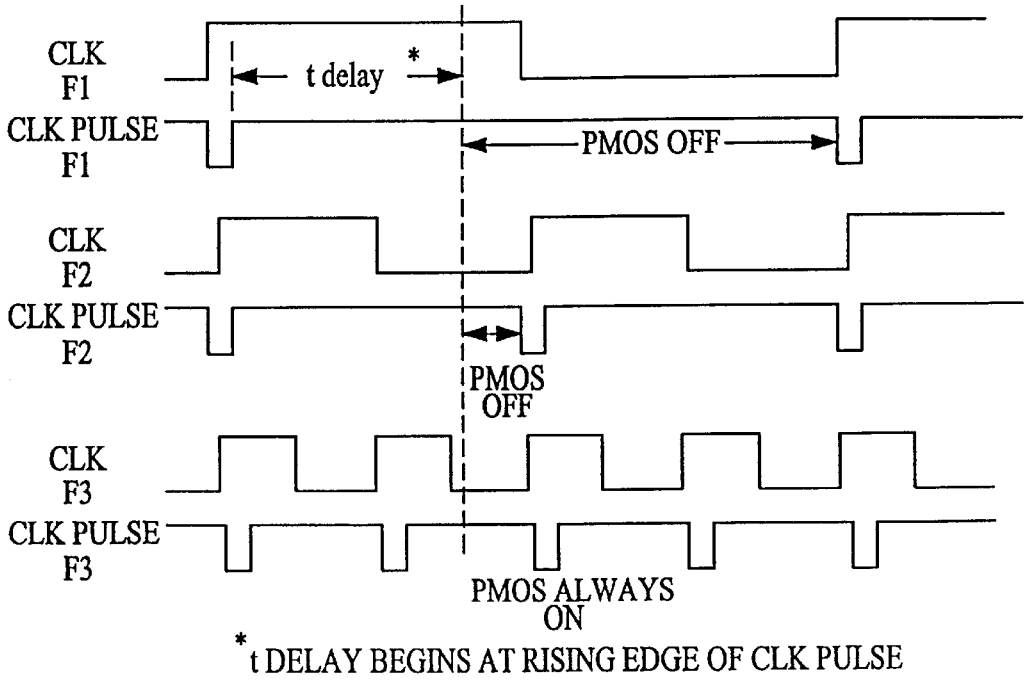

The operation of the voltage regulator 10 of FIG. 1 will be described with respect to the CLK 27 and CLK PULSE 24 clock signals illustrated in FIGS. 4A and 4B. FIGS. 4A and 4B illustrate clock signals having a respective frequency which are generated by the respective system in which the voltage regulator 10 is installed. For example, the system may have a clock frequency of 100 MHz or 300 MHz. The pulse generator 25 generates a fixed-width, low going pulse for each rising edge of the system clock, CLK 27. The clock signal CLK PULSE 24 is input to delay circuit 40 and specifically to the reset input of each delay chain 50*a*–50*e* as illustrated in FIG. 2. The reset input of each delay chain 50*a*–50*e* is connected to input 62 of NAND gate 58 within each delay chain as illustrated in FIG. 3. Thus, the input 62 to NAND gate 58 will alternate between a high logic level and a low logic level corresponding to the clock pulse signal CLK PULSE 24 of the system.

As noted with respect to FIG. 2, the input 51 of the first delay chain 50*a* is connected to ground. Thus, the signal input to the input 60 of NAND gate 58 of delay chain 50*a* will be a logic high signal. The output 53 of delay chain 50*a* will thus go high when the CLK PULSE 24 signal goes low and go low when the CLK PULSE 24 signal returns high after some time period $t_a$ due to the delay of NAND gate 58. The outputs from delay chains 50*b*–50*e* will be similar to that of the output of delay chain 50*a*, except for an additional time delay for each successive delay chain, as shown in FIG. 4A. Thus, the low ground signal input to input 51 of delay chain 50*a* will ripple through each delay chain and be input to the series of inverters 52 if CLK PULSE 24 remains at a logic high level long enough. By varying the number of delay chains in delay circuit 40, the total time delay for the ground signal to reach the inverters 52 can be set to a predetermined time.

When the input to inverters 52 is a logic high, the output 26 from delay circuit 40 will be low, keeping transistor 22 in an on state. When the input to inverters 52 is a logic low, the output 26 from the delay circuit 40 will be high, turning transistor 22 off. Each time the CLK PULSE 24 signal goes low, each of the delay chains of delay 40 will be reset, i.e., output a logic high regardless of the logic state being input to the delay chain from a previous delay chain, turning transistor 22 on. Thus, if the logic high time of the CLK PULSE 24 signal is longer than the delay time of delay circuit 40, the low ground signal will ripple through delay circuit 40 and shut off transistor 22. If the logic high time of the CLK PULSE 24 signal is less than the delay time of delay circuit 40, the logic low time of the CLK PULSE signal will reset each delay chain before the low ground signal can ripple out, pulling the output from delay circuit 40 low, thus keeping transistor 22 on. In this manner, the delay circuit 40 regulates the amount of current delivered to the load as a function of the frequency of the clock.

FIG. 4B illustrates a timing diagram for three clock pulse signals F1, F2, and F3, each having a different frequency. Suppose the delay time of delay circuit 40 is set to some time $_{tdelay}$. As shown in FIG. 4B, clock pulse signals F1 and F2 have a high time longer than the delay time $t_{delay}$, thus allowing the ground signal input to the first delay chain of delay circuit 40 to ripple through delay circuit 40 and turn transistor 22 off for remainder of the time. When the clock pulse signals F1 and F2 go to a logic low, the delay circuit 40 is reset, outputting a logic low and turning transistor 22 on again. By "pulsing" the current provided to the load in this fashion, the voltage variance of Vreg is reduced.

Clock pulse signal F3 has a shorter pulse period and thus a "high" time which is shorter than the delay time $t_{delay}$, thus not allowing the ground signal input to the first delay chain of delay circuit 40 to ripple through delay circuit 40, as each delay chain is reset each time the clock pulse signal goes low. Thus, transistor 22 remains on for the entire duration of clock pulse signal F3. Accordingly, the frequency of the clock pulse signal is used to adjust the current to the load 18 by controlling the gate voltage of transistor 22 (FIG. 1). In addition, the value of $t_{delay}$ is set to correspond to the period, and thus frequency, at which the regulator begins to pulse off.

In accordance with the present invention, a frequency sensing NMOS voltage regulator is provided that is easy to implement since it only requires a simple delay circuit 40 which sets the cycle time, or frequency, at which the regulator starts pulsing off the supplied current to the load, does not occupy significant layout area when the voltage regulator is incorporated in an integrated circuit (IC), and provides a minimal variance of the regulated supply voltage Vreg over a wide current range.

Figure 5:
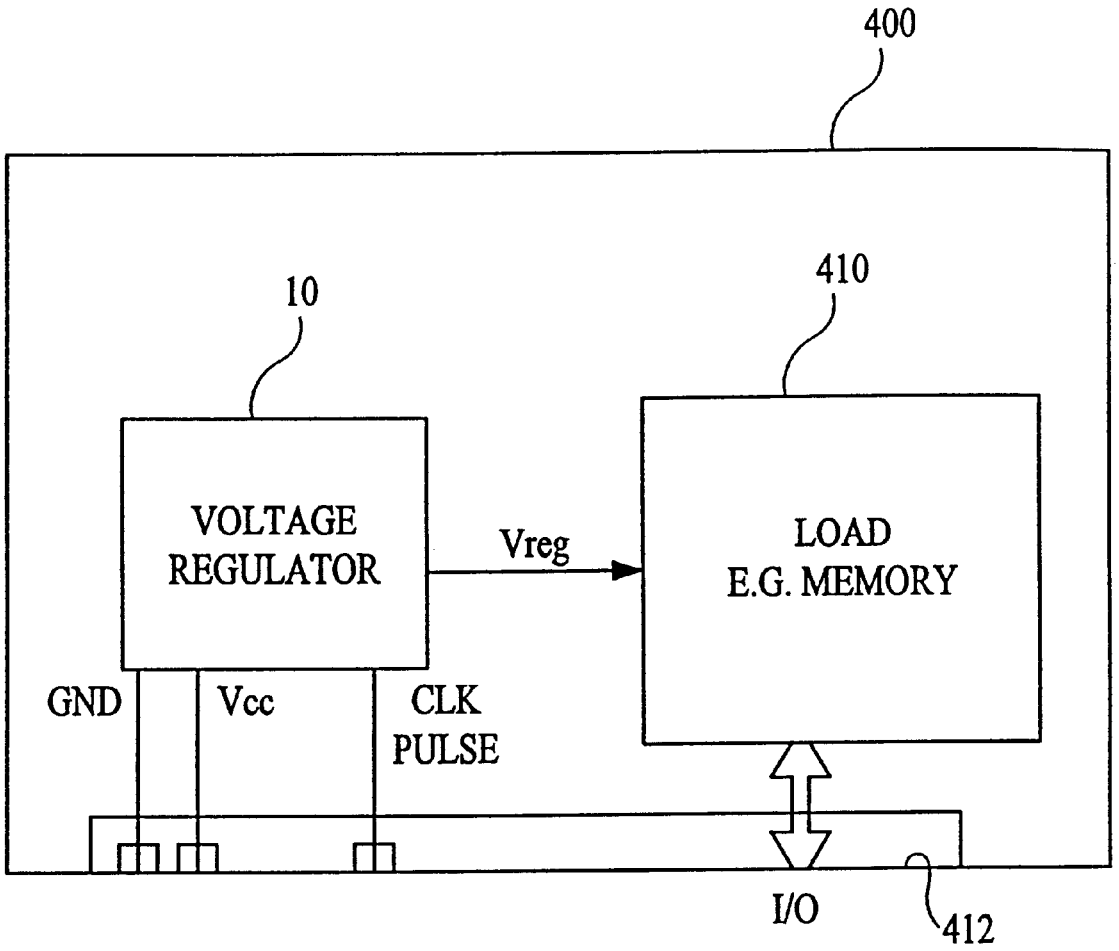
FIG. 5 illustrates in block diagram form an integrated circuit that utilizes a voltage regulator in accordance with the present invention.

FIG. 5 illustrates in block diagram form an integrated circuit 400 that uses the voltage regulator 10 according to the present invention. Integrated circuit 400 includes a memory circuit 410, such as for example a RAM. A plurality of input/output connectors 412 are provided to connect the integrated circuit to an end-product system. Connectors 412 may include connectors for the supply voltage Vcc, ground (GND), clock signal CLK PULSE 24, and input/output terminals (I/O) for data from memory 410. Memory 410 is powered by a regulated voltage Vreg from voltage regulator 10.

It should be noted that while the invention has been described and illustrated in the environment of a memory circuit, the invention is not limited to his environment. Instead, the invention can be used in any synchronous system in which current varies linearly with clock frequency.

Figure 6:
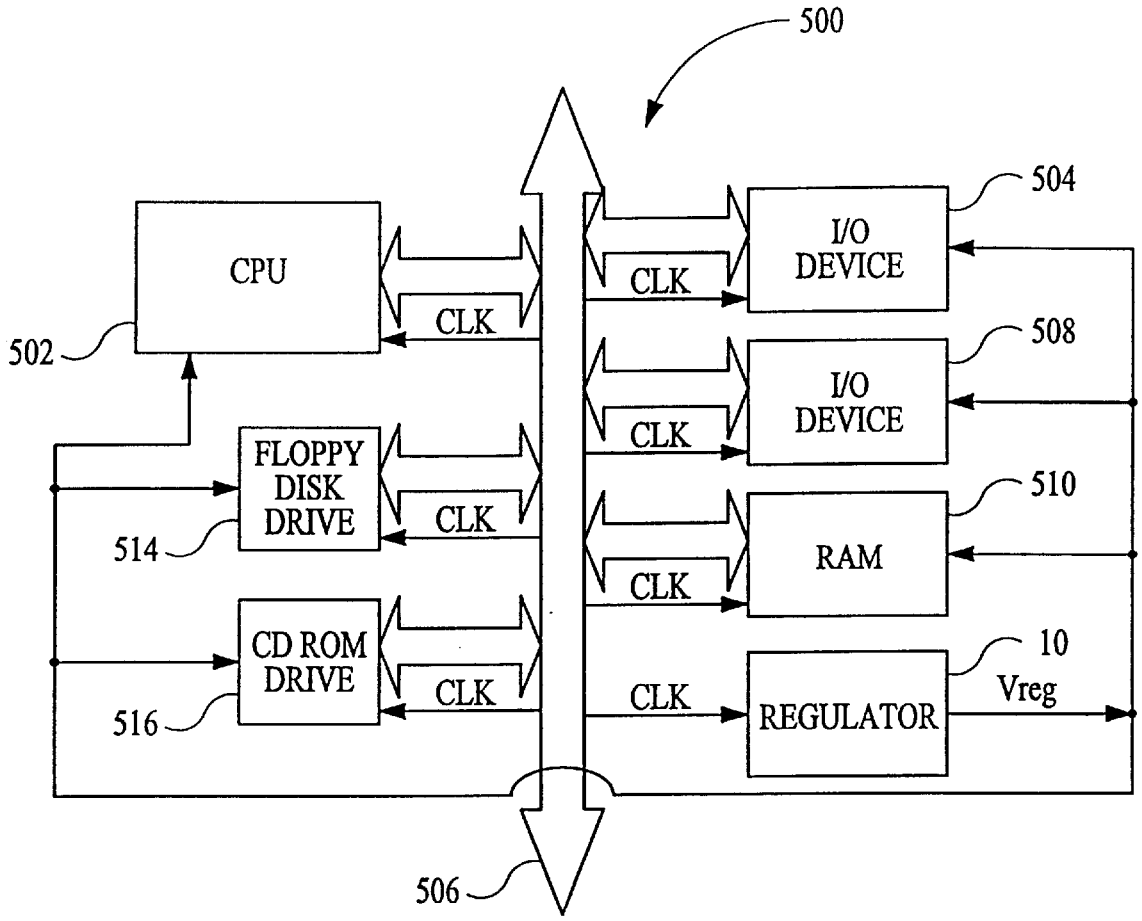
FIG. 6 illustrates in block diagram form a processor system that utilizes a voltage regulator in accordance with the present invention.

A typical processor system which includes a memory circuit which in turn has a voltage regulator according to the present invention is illustrated generally at 500 in FIG. 6. A computer system is exemplary of a processor system having digital circuits which include memory devices. Other types of dedicated processing systems, e.g. radio systems, television systems, GPS receiver systems, telephones and telephone systems also contain memory devices which can utilize the present invention.

A processor system, such as a computer system, generally comprises a central processing unit (CPU) 502 that communicates with an input/output (I/O) device 504 over a bus 506. A second I/O device 508 is illustrated, but may not be necessary depending upon the system requirements. The computer system 500 also includes random access memory (RAM) 510. Power to the RAM 510 is provided by voltage regulator 10 in accordance with the present invention. Computer system 500 may also include peripheral devices such as a floppy disk drive 514 and a compact disk (CD) ROM drive 516 which also communicate with CPU 502 over the bus 506. Indeed, as shown in FIG. 6, in addition to RAM 510, any and all elements of the illustrated processor system may employ the invention. It should be understood that the exact architecture of the computer system 500 is not important and that any combination of computer compatible devices may be incorporated into the system.

In accordance with the present invention, voltage regulator 10 provides a minimal variance of the regulated supply voltage Vreg over a wide current range to a regulated device, e.g. a SRAM, or other synchronous device where load current varies linearly with clock frequency.

While a preferred embodiment of the invention has been described and illustrated above, it should be understood that this is exemplary of the invention and is not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed as new and desired to be protected by Letters Patent of the United States is:

1. A method for regulating a supply voltage to a memory device comprising the steps of:

generating a clock pulse signal based on a system clock signal;

providing said clock pulse signal to a delay circuit;

determining a control signal based on said clock pulse signal and a delay time of said delay circuit;

providing said determined control signal to a gate of a transistor, said transistor having a first terminal coupled to said supply voltage and a second terminal coupled to said memory device, said transistor turning on and off in response to said control signal; and regulating said supply voltage passed through said transistor to said memory device by turning on and off said transistor.

2. The method according to claim 1, wherein said step of determining a control signal further comprises:

determining a first control signal if said clock pulse signal maintains a first logic level for a time period longer than said delay time of said delay circuit.

3. The method according to claim 2, wherein said step of regulating further comprises:

turning off said transistor in response to said first control signal to disconnect said supply voltage from said memory device.

4. The method according to claim 2, wherein said step of determining a control signal further comprises:

determining a second control signal if said clock pulse signal does not maintain said first logic level for a time period longer than said delay time of said delay circuit.

5. The method according to claim 4, wherein said step of regulating further comprises:

maintaining said transistor in an on state in response to said second control signal to pass said supply voltage through said transistor to said memory device.

6. The method according to claim 4, wherein said first logic level is a high logic level.

7. The method according to claim 1, wherein said step of generating a clock pulse signal further comprises:

generating a low logic level pulse signal for each rising edge of said system clock signal.

8. The method according to claim 7, wherein said step of generating further comprises:

generating a fixed-width low logic level pulse signal.

9. The method according to claim 7, wherein said step of determining a control signal further comprises:

providing said clock pulse signal to a delay stage in said delay circuit, said delay stage resetting said control signal to turn on said transistor based on said low logic level pulse signal.

10. The method according to claim 9, further comprising:

providing said clock pulse signal to a first input of a NAND gate in said delay stage, said NAND gate having a second input coupled to a ground signal and an output coupled to said gate of said transistor to provide said control signal.

11. The method according to claim 7, wherein said step of determining a control signal further comprises:

providing said clock pulse signal to a plurality of delay stages in said delay circuit, said plurality of delay stages resetting said control signal to turn on said transistor based on said low logic level pulse signal, said plurality of delay stages determining said delay time of said delay circuit.

12. A method for regulating a current to a load comprising the steps of:

generating a clock pulse signal based on a system clock signal;

determining a control signal based on said clock pulse signal and a delay time of a delay circuit into which said clock pulse signal is input; and regulating said current to said load by turning on and off a transistor through which said current passes in response to said control signal.

13. The method according to claim 12, wherein said step of determining a control signal further comprises:

determining a first control signal if said clock pulse signal maintains a first logic level for a time period longer than said delay time of said delay circuit.

14. The method according to claim 13, wherein said step of regulating further comprises:

turning off said transistor in response to said first control signal to prevent passage of said current to said load.

15. The method according to claim 13, wherein said step of determining a control signal further comprises:

determining a second control signal if said clock pulse signal does not maintain said first logic level for a time period longer than said delay time of said delay circuit.

16. The method according to claim 15, wherein said step of regulating further comprises:

maintaining said transistor in an on state in response to said second control signal to pass said current through said transistor to said load.

17. The method according to claim 15, wherein said first logic level is a high logic level.

18. The method according to claim 12, wherein said current varies linearly with a frequency of said system clock signal.

19. The method according to claim 12, wherein said step of generating a clock pulse signal further comprises:

generating a low logic level pulse signal for each rising edge of said system clock signal.

* * * * *